US006003697A

United States Patent [19]

Ferchat et al.

[11] Patent Number: 6,003,697

[45] Date of Patent: Dec. 21, 1999

[54] SUPPORT ASSEMBLY FOR ATTACHING A SIGN

[75] Inventors: Craig S. Ferchat, Mississauga; Johann Andre Van Der Linde, Kitchener; Martin Cross; Adrian W. Pynenburg, both of Brantford, all of Canada

[73] Assignee: Storeimage Programs Inc., Brantford, Canada

[21] Appl. No.: 09/156,746

[22] Filed: Sep. 17, 1998

[51] Int. Cl.[6] ..... A47F 5/00

[52] U.S. Cl. ..... 211/189; 211/186; 40/601

[58] Field of Search ..... 211/189, 191, 211/190, 186, 187, 104; 40/601; 108/108, 109

[56] References Cited

U.S. PATENT DOCUMENTS

| | | | |
|---|---|---|---|
| 4,541,675 | 9/1985 | Everett | 211/190 X |
| 4,611,866 | 9/1986 | Everett | 211/190 X |
| 4,762,235 | 8/1988 | Howard et al. | 211/59.3 |
| 5,014,862 | 5/1991 | Bustos | 211/189 X |
| 5,272,991 | 12/1993 | Carrigan | 108/108 |
| 5,437,116 | 8/1995 | Hardy | 211/189 X |
| 5,526,944 | 6/1996 | Merl | 211/104 |
| 5,924,367 | 7/1999 | Henke et al. | 108/108 |

*Primary Examiner*—Robert W. Gibson, Jr.
*Attorney, Agent, or Firm*—Howard J. Greenwald

[57] ABSTRACT

A support assembly for attaching a sign to a pallet rack which contains a bracket and a support body slidably connected to the bracket. The bracket may be fixed in place upon a pallet rack, and the support body may be raised with respect to the fixed bracket, lowered with respect to the fixed bracket, or tiltably locked in place with respect to the fixed bracket.

19 Claims, 10 Drawing Sheets

SUPPORT ASSEMBLY FOR ATTACHING A SIGN

FIELD OF THE INVENTION

A support assembly for attaching a sign to a pallet rack.

BACKGROUND OF THE INVENTION

Merchandise storage systems, such as pallet racks, often contain header sign assemblies which contain signs with advertising messages. These signs are frequently displayed in front of merchandise mounted on the racks and thus often must be moved in order to gain access to the merchandise.

It is an object of this invention to provide a support assembly for attaching a sign to a pallet rack which allows one to readily tilt the sign in order to gain access to merchandise disposed behind it.

SUMMARY OF THE INVENTION

In accordance with this invention, there is provided a support assembly for attaching a sign to a pallet rack. The assembly contains a bracket, means for attaching the bracket to a pallet rack, a support body slidably attached to the bracket, means for raising and lowering the support body with respect to the bracket, means for tilting the support body so that it forms an acute angle with the bracket, and means for locking the support body into a position in which it forms an acute angle with the bracket.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
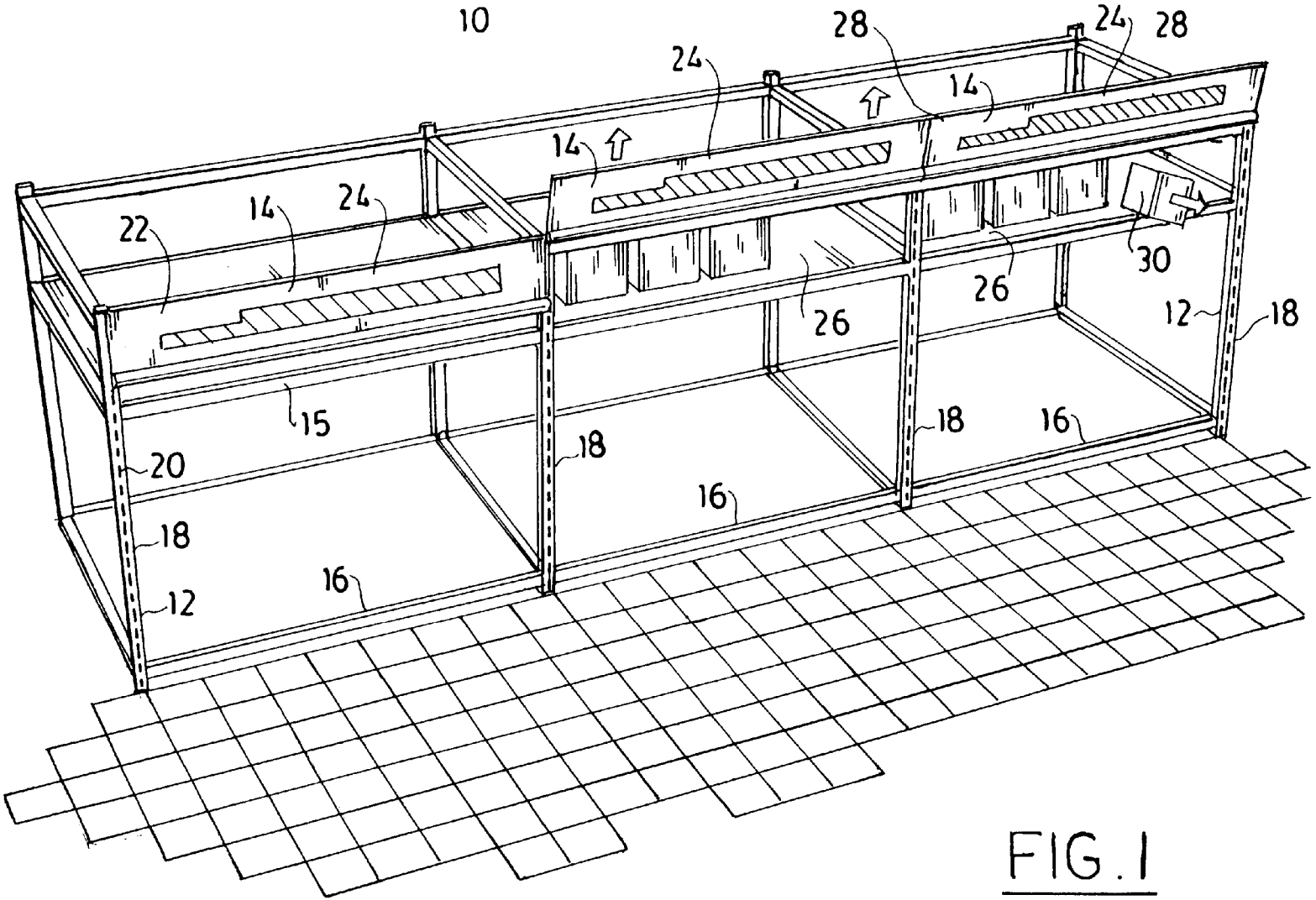
FIG. 1 is a perspective view of a pallet rack with the support assembly of this invention attached to it.

One preferred embodiment of the support assembly of this invention is illustrated in FIG. 1. This FIG. 1 is a perspective view of a storage racking system 10 which is comprised of a pallet rack 12 with a header sign assembly 14.

Merchandise storage systems, such as pallet racks, are well known to those skilled in the art and are described, e.g., in U.S. Pat. No. 5,595,311 (storage rack system), U.S. Pat. Nos. 5,573,125, 5,531,158, 5,524,776, 5,474,412 (flow rack system), U.S. Pat. No. 5,419,444 (push back rack assembly), U.S. Pat. Nos. 5,316,428, 5,285,909, 5,178,288 (push back pallet rack), U.S. Pat. Nos. 5,170,896, 5,170,829 (retractable pallet rack), U.S. Pat. Nos. 4,982,851, 4,915,240, 4,773,546, 4,729,484, 4,618,064, 4,564,134, 4,450,936, 4,291,812, 4,113,110, 4,074,812, 4,068,751, 4,048,059, 3,695,456, 3,625,372, 3,612,290,3,565,264, and the like. The disclosure of each of these United States patents is hereby incorporated by reference into this specification.

Referring again to FIG. 1, the pallet rack 12 is comprised of a base 16 and standard uprights 18. The standard uprights preferably have disposed in them a multiplicity of slots to which one can attach standard shelving (not shown).

This type of pallet rack assembly, and its components, are well known to those skilled in the art and are commercially available. Thus, by way of illustration and not limitation, reference may be had to "Catalogue 983, September/December 1998" which was published by the Avenue Industrial Supply Company, Ltd. of 331 Alden Road, Unit 2, Markham, Ontario, Canada L3R 3L4; see, e.g., pages 45–49 of this catalogue.

Referring again to FIG. 1, and in the preferred embodiment depicted therein, it will be seen that the header sign assembly 14, in position 22, is in its closed state. The header sign assembly 14 is comprised of means for raising the sign 24 to expose the stock area 26 disposed behind the sign 24, and this is shown in FIG. 1 as state 28. As will be apparent, when sign 24 is in its raised position 28, it is also lockably tilted forward to allow the removal of stock item 30.

Figure 2:
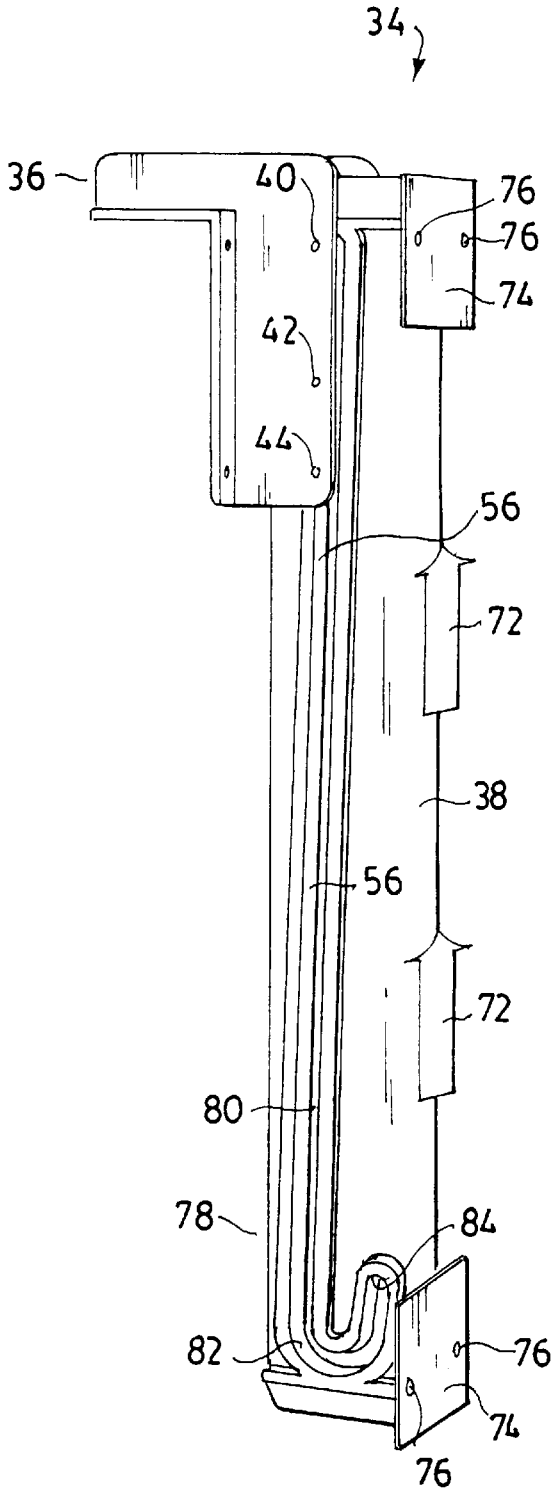
FIG. 2 is a perspective view of one preferred embodiment of the support assembly of this invention in its closed position.

FIG. 2 is a perspective view one preferred embodiment of a movable support system. Referring to FIG. 2, it will be seen that this movable support system is comprised of a bracket 36, a support body 38, means for slidably connecting bracket 36 to support body 38, and means for tilting and removably locking bracket 36 within support body 38. In this preferred embodiment, bracket 36 is comprised of orifices 40, 42, and 44 through which two or more fasteners (not shown in FIG. 2) may be extended. One may use a suitable fastener such as, e.g., a bolt, a pin, etc.

Figure 3:
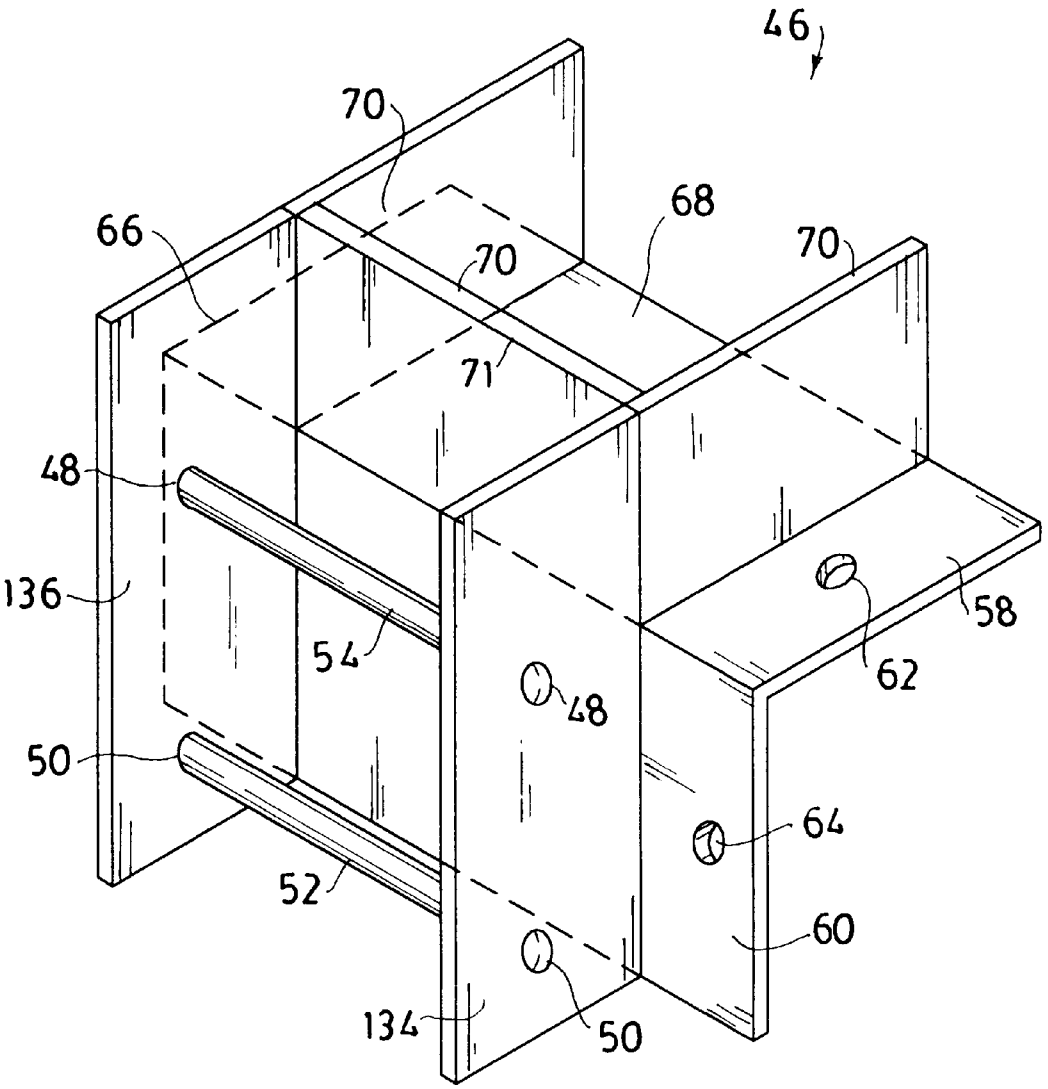
FIG. 3 is a perspective view of one preferred bracket adapted for use with the support assembly of FIG. 2.

FIG. 3 is a schematic view of another preferred bracket 46 which is comprised of orifices 48 and 50 through which pins 52 and 54 are disposed. As will be apparent to those skilled in the art, such pins 52 and 54 allow one to slidably connect bracket 46 (or similar bracket 36) within the slot 56 disposed within body support 38 (see FIG. 2). The bracket 46 also comprises flanges 58 and 60 comprising orifices 62 and 64 for fastening the bracket 46 onto a pallet rack 12 (see FIG. 1). As will be apparent to those skilled in the art, there are similar flanges 58 and 60, and similar orifices 62 and 64, on the left side 66 of the bracket 46, shown in dotted outline.

Referring again to FIG. 3, and in the preferred embodiment depicted therein, it will be seen that the top surface 68 of bracket 46 is comprised of upstanding ridges 70 integrally connected to top surface 68. Without wishing to be bound to any particular theory, applicants believe that these upstanding ridges 70 impart desirable structural rigidity to the bracket 46.

Referring again to FIG. 3, it will be seen that bracket 46 has a rear surface 71 which, in this embodiment, can serve as a reference point for the position of the bracket vis-a-vis support 38. When the bracket 46 (or the similar bracket 36) is on the linear portion of slot 56, its rear surface 71 is generally substantially parallel to slot 56, preferably forming an angle of from about 0 to about 7 degrees with the support body 38. When, however, the bracket 46 (or the bracket 36) is on the curvilinear portion of slot 57, its rear surface 71 forms an angle of at least about 10 degrees with the support body 38 and, preferably, forms an angle of from about 10 to about 25 degrees with such support body 38.

Referring again to FIG. 2, and in the preferred embodiment depicted therein, it will be seen that the support body 38 may be moved in the direction of arrows 72 to raise the body vis-a-vis the bracket 36 and the rack (not shown). The raised position of body 38 corresponds to position 28 depicted in FIG. 1.

FIG. 2 also illustrates that, in the preferred embodiment depicted, the support body 38 contains means for attaching a sign (not shown). In the embodiment depicted, the support body 38 comprises mounting flanges 74 comprised of orifices 76 which may be used to attach a sign thereto. One may use other means for removably attaching a sign to the device such as, e.g., adhesive means, magnetic means, etc.

Referring again to FIG. 2, it will be seen that most of the slot 56 is substantially linear and preferably has a substantially uniform width. However, the bottom portion 78 of the slot 56 undergoes a transition between the linear segment 80 of slot 56 and the curvilinear section 82 of slot 56.

Figure 4:
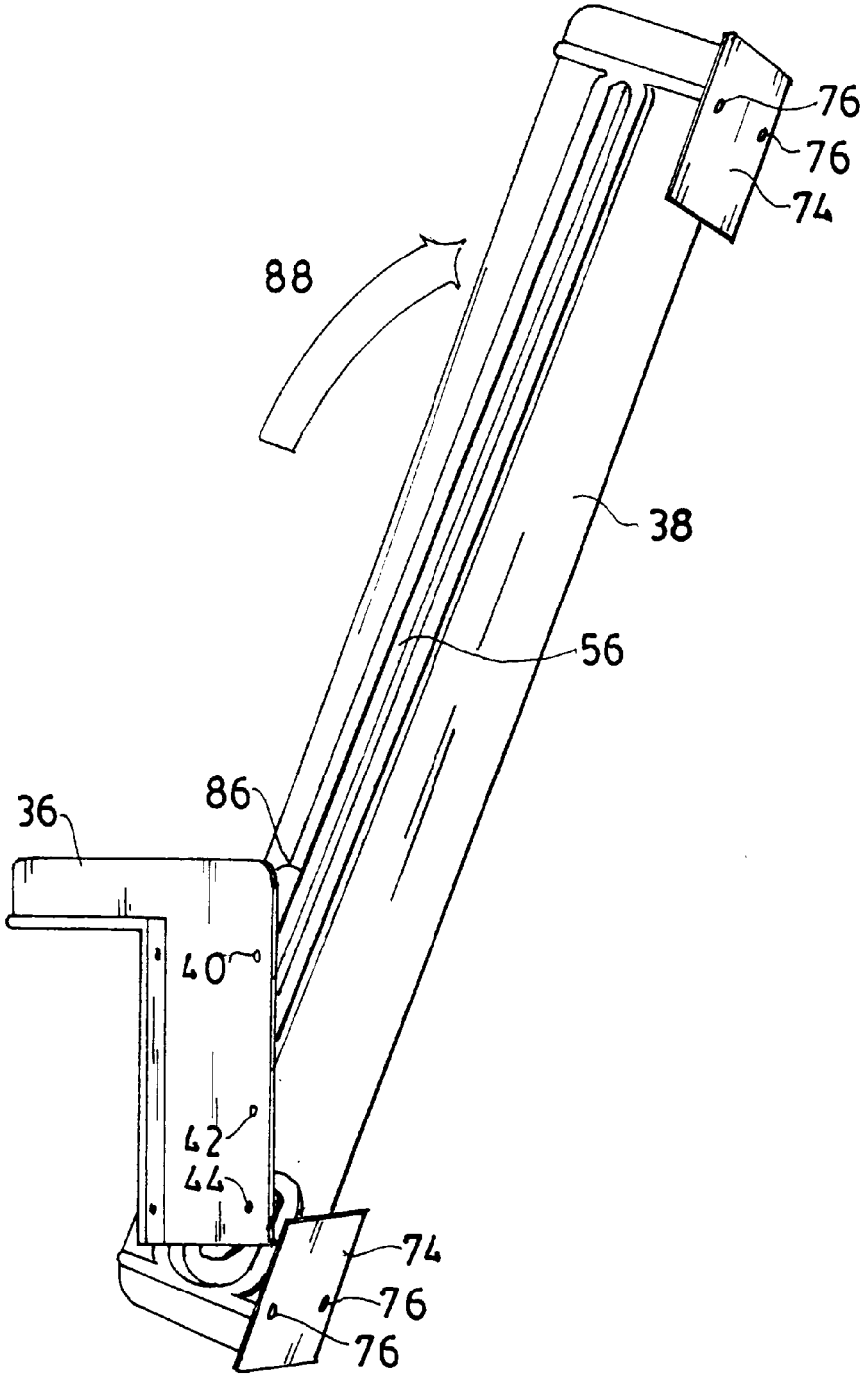
FIG. 4 is a perspective view of the support assembly of FIG. 2 in its open position.

The effect of raising the support body 38 so that the bracket 36 is disposed in both the linear portion 80 of slot 56 and the curvilinear portion 82 of slot 56 is illustrated in FIG. 4. Because the curvilinear portion 82 has a constantly changing slope, when the bracket 36 is pushed to the limit of its travel 84 within segment 82 (see FIG. 2), it will necessarily be disposed at a different angle 86 vis-a-vis the support body 38 than it is when it is in the position depicted in FIG. 2; thus, the support body will be forced to tilt forwardly, in the direction of arrow 88, vis-a-vis the bracket 36 and the rack (not shown) to which it is affixed. Furthermore, the support body will be removably locked in a tilted position.

Figure 7:
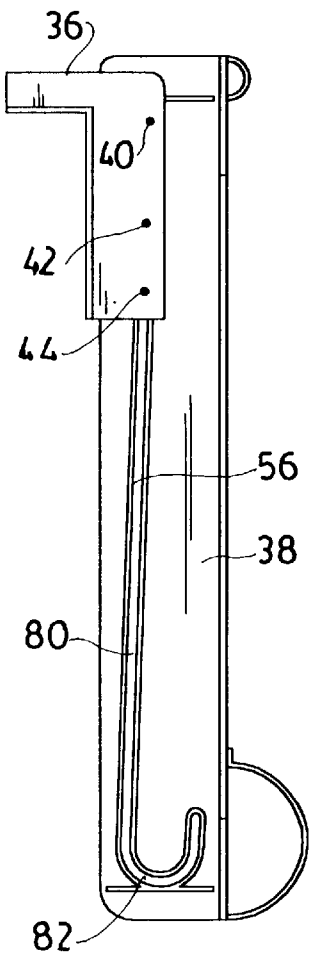
FIGS. 5, 6, and 7 illustrate means for disposing a portion of the bracket of FIG. 3 within the slot contained in the support assembly of FIG. 2.
Figure 6:
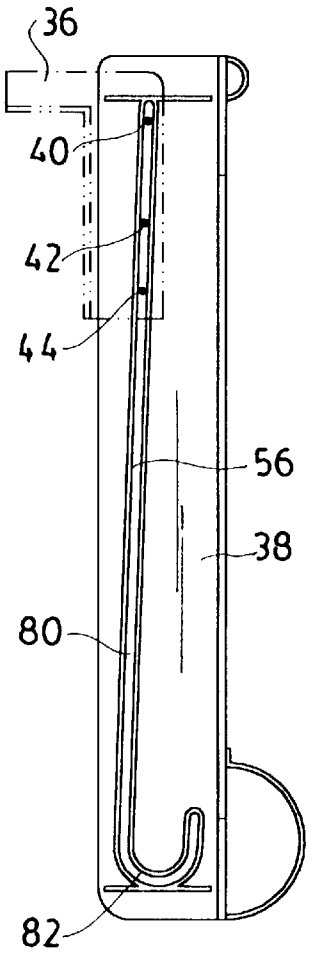
Figure 5:
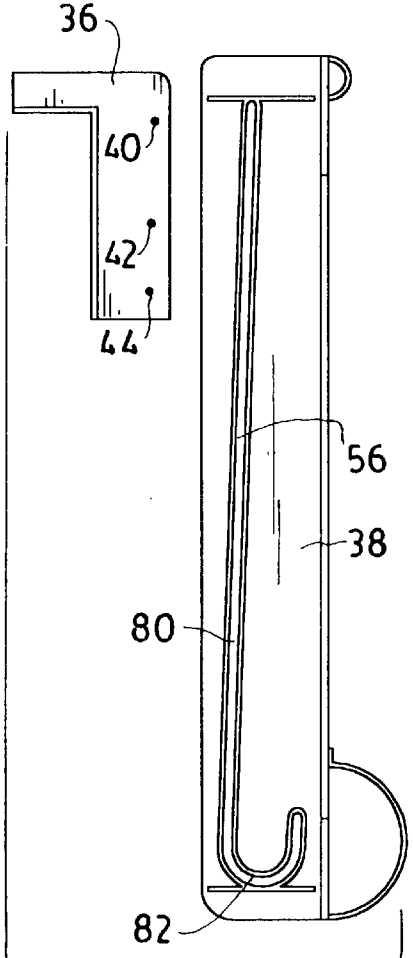

FIGS. 5, 6, and 7 illustrate how the bracket 36 may be slidably attached to support 38 within slot 56. As is apparent to such Figures, the orifices 40, 42, and 44 are aligned with slot 56 and suitable fasteners (not shown) are then inserted through such orifices and such slot.

Figure 8:
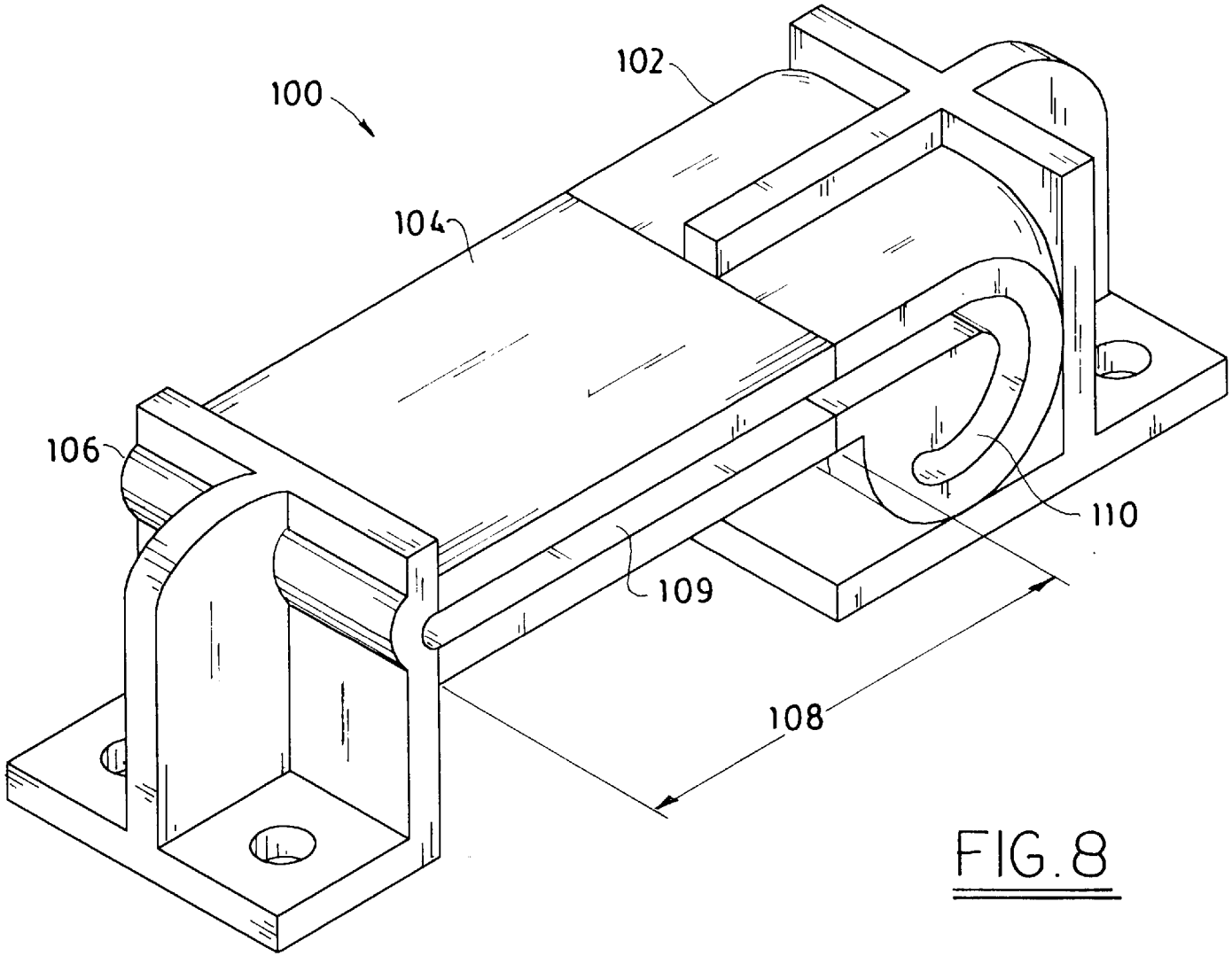
FIG. 8 is a perspective view of another preferred embodiment of the support assembly of this invention.

FIG. 8 is a perspective view of another preferred support 100 which is comprised of a slotted base 102, a slotted section 104 removably attached to base 102, and a top section 106 removably attached to center section 104. As will be apparent, as the length 108 of center section 106 is varied, the overall length of support assembly 100 may be varied to accommodate signs of different sizes.

The length of center section 104 may be varied by conventional means. Thus, by way of illustration, center section 104 may be provided as an extruded plastic piece which may be cut to size. Alternatively, or additionally, center section 104 may be provided with male and female connectors at its ends to join to other similarly configured center sections.

Referring again to FIG. 8, it will be seen that center section 104 is comprised of a substantially linear slot 109, and base section 102 is comprised of a substantially curvilinear slot 110. Thus, the device of this FIG. 8 operates in substantially the same manner as the device of FIGS. 1–7 and differs therefrom only in that it contains separable sections.

Figure 9:
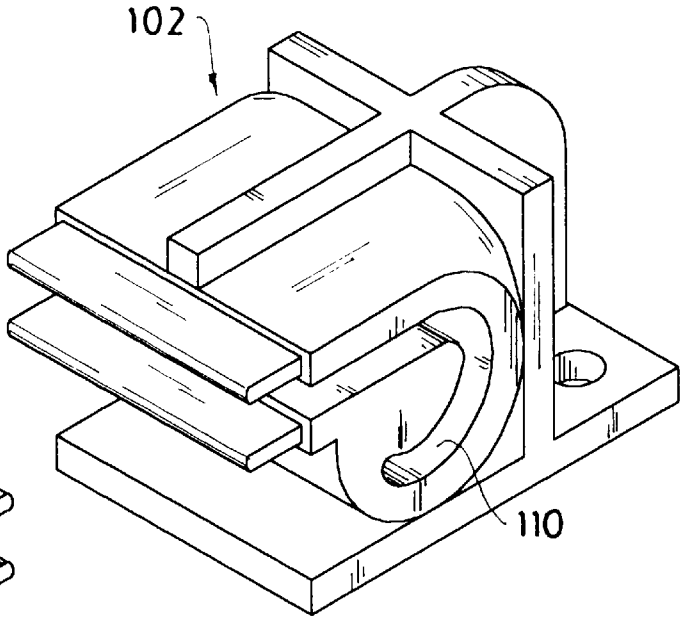
FIGS. 9, 10, and 11 are perspective views of the left, middle, and right portions of the support assembly of FIG. 8.
Figure 10:
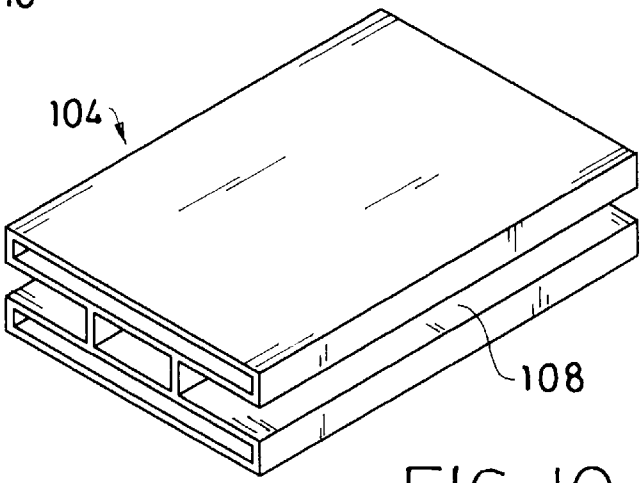
Figure 11:
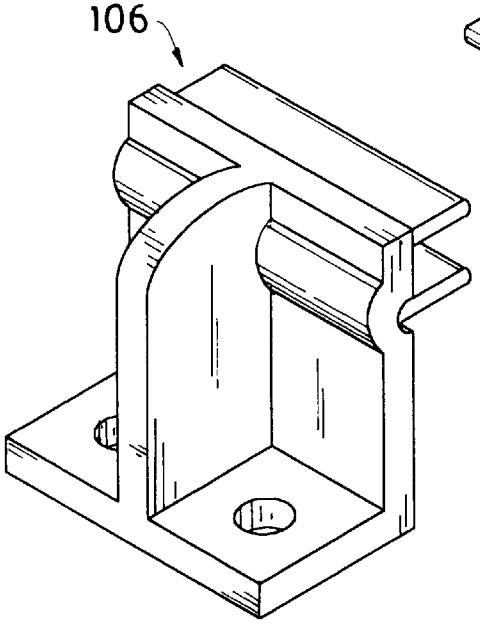

FIGS. 9, 10, and 11 are perspective views of the base 102, center section 104, and top section 106 depicted in FIG. 8.

Figures 12, 13, 14:
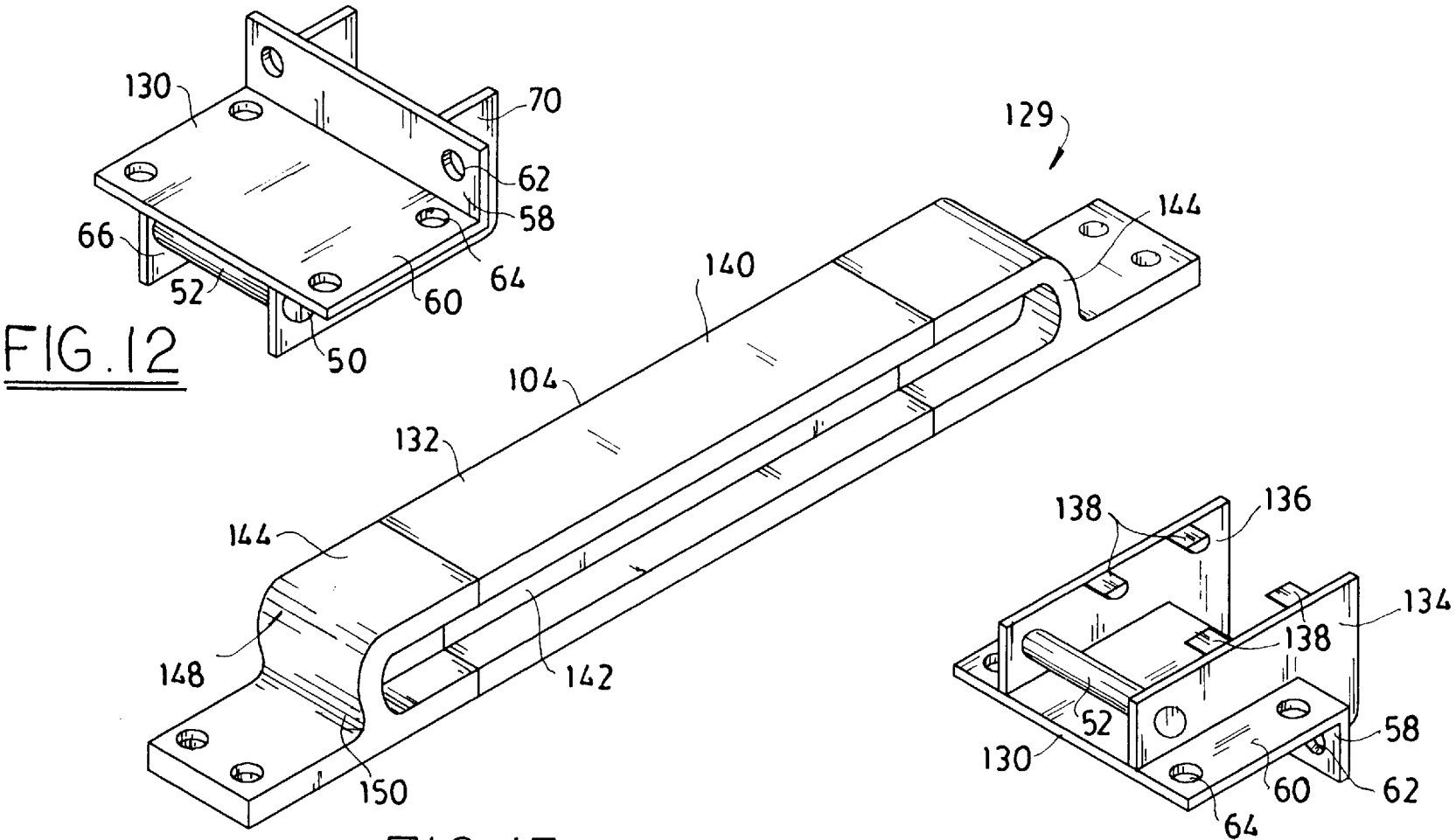
FIGS. 12, 13, and 14 are perspective views of a bracket (top view), and support body, and a bracket (bottom view) of another preferred embodiment of the support assembly of this invention.

FIGS. 12, 13, and 14 illustrate another preferred support system 129 of the invention which is substantially lighter, less expensive to make, and more rigid than the devices described in FIGS. 1–11. Referring to these Figures, it will be seen that bracket 130 is similar to the bracket 46 illustrated in FIG. 3, with the exception that it utilizes a different means for sliding upon support 132. Referring to FIG. 12, which is a bottom view of bracket 130, it will be seen that flanges 134 and 136 are preferably integrally connected to both pin 52 and inwardly-extending guide pins 138. As will be apparent, the pin 52 rides upon the top surface 140 of support 132, and the guiding pins 138 ride within slot 142 of support 132.

The support 132 preferably is comprised of a center piece 104, an end piece 142, and an end piece 144. These pieces are removably attached to each other and, when they are disassembled, the pins 52 and 138 can be positioned on center piece 104 prior to reassembly.

Figure 15:
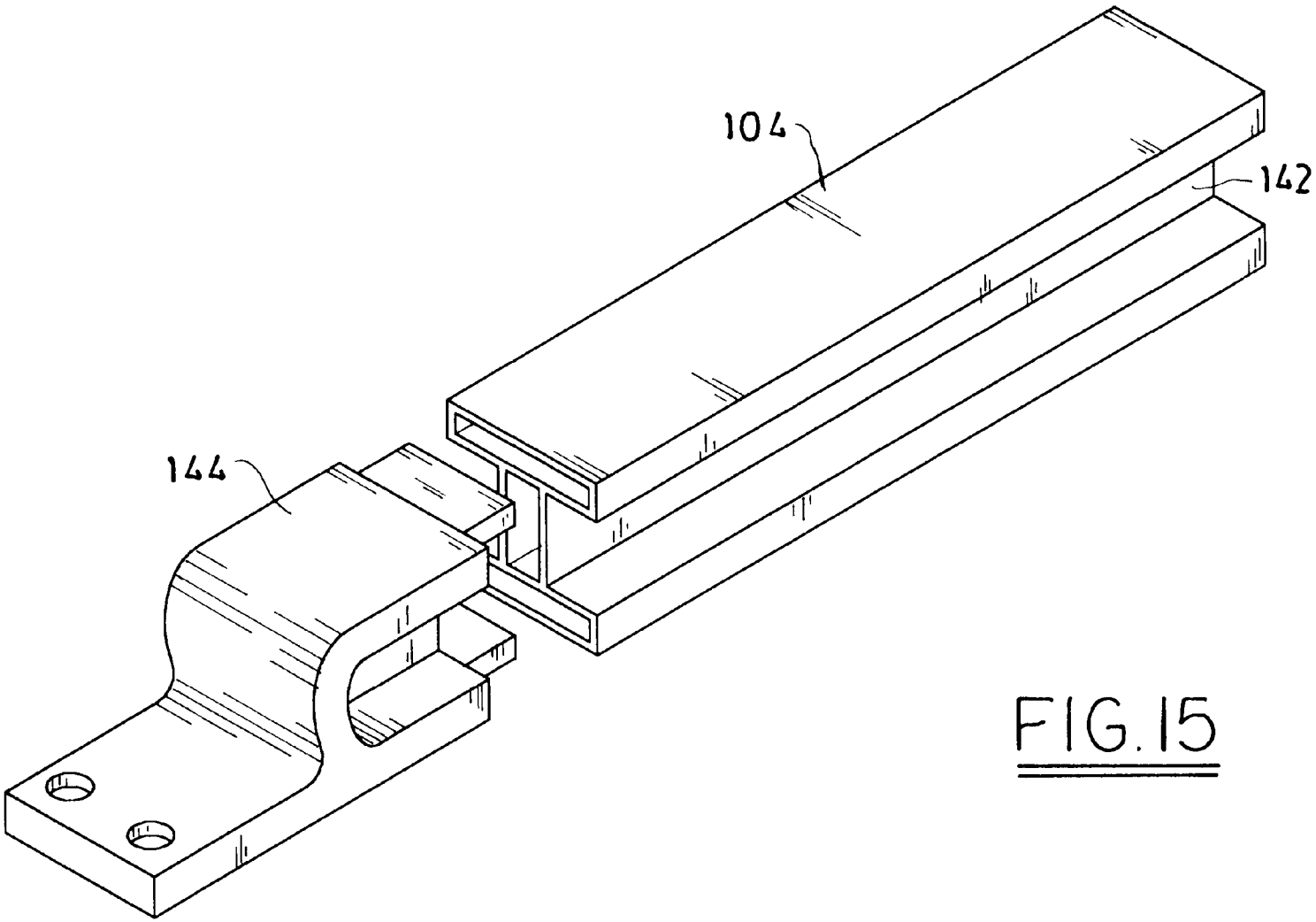
FIG. 15 is a partial exploded view of the support assembly of FIGS. 12, 13, and 14.

The center piece 104, the end piece 142, and the end piece 144 may be removably attached to each other by conventional means FIG. 15 illustrates one such means of attachment.

Figure 16:
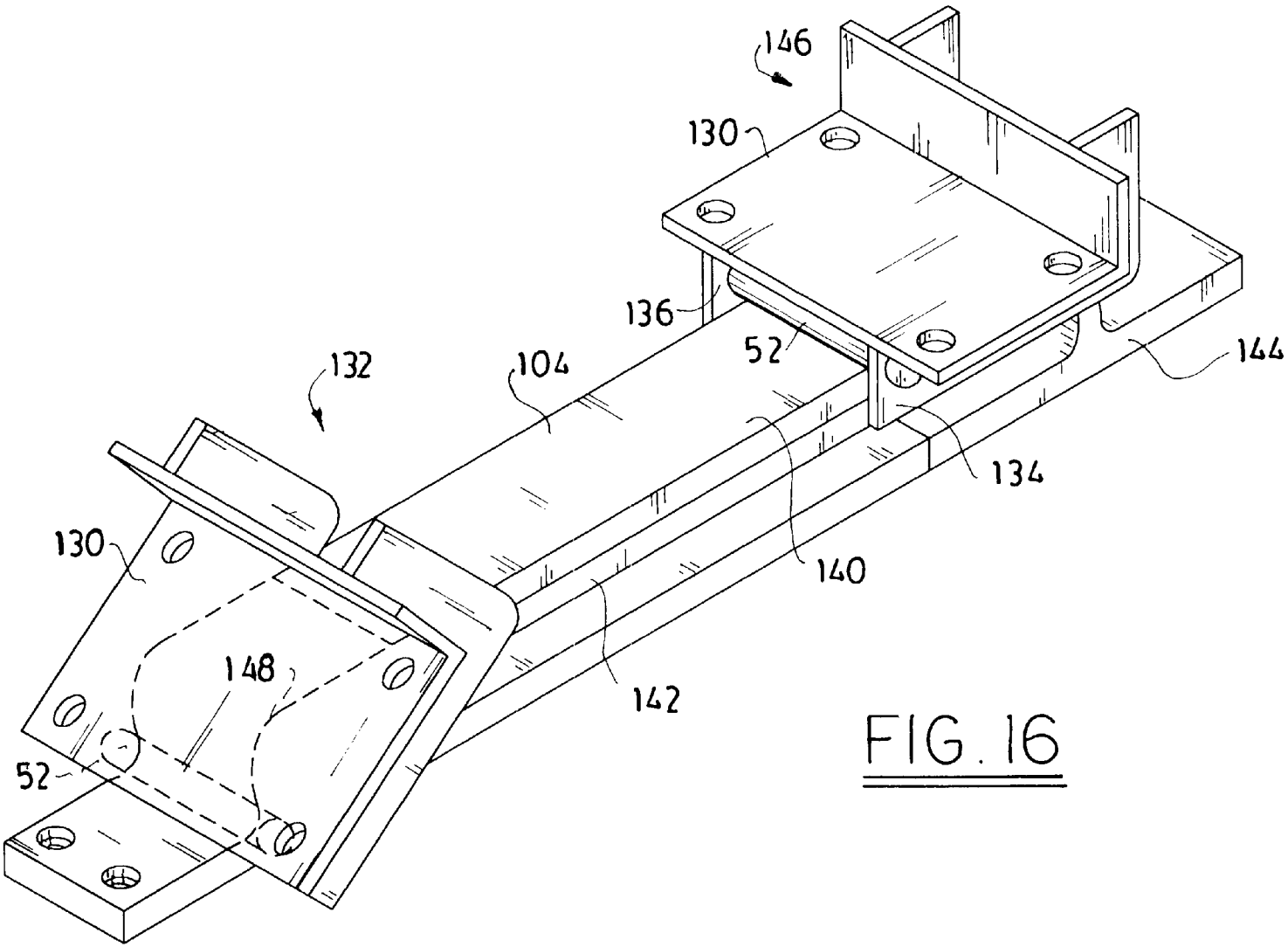
FIG. 16 is a perspective view showing bracket 130 disposed in two separate positions on the body of the support assembly of FIGS. 12, 13, and 14.

FIG. 16 illustrates how the bracket 130 rides upon support 132. In the position 146, the pin 52 is substantially contiguous with the top surface 140 of support 132, the pins 138 are disposed within slot 142, and the bracket 130 is substantially parallel to the top surface 140. However, as the bracket approaches the curved surface 148, pin 52 travels downwardly until it contacts partial recess 150 (see FIG. 13), thereby stopping the motion of bracket 130, tilting such bracket upwardly, and locking such bracket within recess 150.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A support assembly for attaching a sign to a pallet rack, wherein said support assembly is comprised of a bracket, a support body slidably connected to said bracket, means for connecting a sign to said support body, means for raising said support body with respect to said bracket, means for lowering said support body with respect to said bracket, means for moving said support body so that it forms an acute angle with said bracket, and means for removably locking said support body into a position into which it forms said acute angle with said bracket.

2. The support assembly as recited in claim 1, wherein said support body is comprised of a slot disposed within said support body.

3. The support assembly as recited in claim 2, wherein said support body is comprised of a center section and a first end section removably attached to each other.

4. The support assembly as recited in claim 3, wherein said support body is further comprised of a second end section removably attached to said center section.

5. The support assembly as recited in claim 4, wherein said center section is comprised of a slot extending substantially the entire length of said center section.

6. The support assembly as recited in claim 5, wherein said center section is comprised of a top surface which is substantially parallel to said slot.

7. The support assembly as recited in claim 6, wherein said center section is comprised of a bottom surface which is substantially parallel to said slot.

8. The support assembly as recited in claim 7, wherein said first end section is comprised of a slot.

9. The support assembly as recited in claim 8, wherein said second end section is comprised of a slot.

10. The support assembly as recited in claim 9, wherein said first end section is comprised of a curvilinear recess.

11. The support assembly as recited in claim 10, wherein said bracket is comprised of a rod.

12. A merchandise storage system comprised of a pallet rack attached to a support assembly, wherein said support assembly is comprised of a bracket, a support body slidably connected to said bracket, means for connecting a sign to said support body, means for raising said support body with respect to said bracket, means for lowering said support body with respect to said bracket, means for moving said support body so that it forms an acute angle with said bracket, and means for removably locking said support body into a position into which it forms said acute angle with said bracket.

13. The merchandise storage system as recited in claim 12, wherein said support body is comprised of a slot disposed within said support body.

14. The merchandise storage system as recited in claim 13, wherein said support body is comprised of a center section and a first end section removably attached to each other.

15. The merchandise storage system as recited in claim 14, wherein said support body is further comprised of a second end section removably attached to said center section.

16. A merchandise storage system comprised of a pallet rack, a support assembly attached to said pallet rack, and a sign attached to said support assembly, wherein said support assembly is comprised of a bracket, a support body slidably connected to said bracket, means for connecting a sign to said support body, means for raising said support body with respect to said bracket, means for lowering said support body with respect to said bracket, means for moving said support body so that it forms an acute angle with said bracket, and means for removably locking said support body into a position into which it forms said acute angle with said bracket.

17. The merchandise storage system as recited in claim 16, wherein said support body is comprised of a slot disposed within said support body.

18. The merchandise storage system as recited in claim 17, wherein said support body is comprised of a center section and a first end section removably attached to each other.

19. The merchandise storage system as recited in claim 18, wherein said support body is further comprised of a second end section removably attached to said center section.

* * * * *